US005807093A

United States Patent [19]

Tendick, Sr.

[11] Patent Number: 5,807,093

[45] Date of Patent: Sep. 15, 1998

[54] FLAMEGUARD FOR OUTDOOR TORCH

[75] Inventor: Donald W. Tendick, Sr., 3685 Emberwood, Brookfield, Wis. 53005

[73] Assignee: Donald W. Tendick, Sr.

[21] Appl. No.: 745,613

[22] Filed: Nov. 7, 1996

[51] Int. Cl.[6] ..... F23Q 25/00

[52] U.S. Cl. ..... 431/146; 431/320; 431/343

[58] Field of Search ..... 431/343, 344, 431/345, 125, 310, 320, 146

[56] References Cited

U.S. PATENT DOCUMENTS

| | | | |
|---|---|---|---|
| 4,477,247 | 10/1984 | Kumasaka | 431/146 |
| 4,544,348 | 10/1985 | Boij | 431/146 |
| 4,917,598 | 4/1990 | Stoner | 431/320 |
| 5,057,003 | 10/1991 | Yang | 431/125 |
| 5,547,371 | 8/1996 | Rose | 431/320 |

*Primary Examiner*—Larry Jones

*Attorney, Agent, or Firm*—Michael, Best & Friedrich LLP

[57] ABSTRACT

The outdoor torch has a housing including a receptacle for removably receiving a flaming illumination means, such as an oil burner assembly, a support connected to the lower end of the housing for support the housing in an upright position and a flameguard of a fire resistant material, preferably in the form of a generally cylindrical sleeve and having opposed open ends, surrounding the outer surface of the housing for preventing flame from the oil burner assembly from contacting the housing.

5 Claims, 2 Drawing Sheets

FLAMEGUARD FOR OUTDOOR TORCH

BACKGROUND OF THE INVENTION

This invention relates to outdoor torches and, more particularly, to outdoor torches for patios or similar settings including a housing for removably receiving a flaming illumination means, such as an oil lamp, candle or the like.

One type of outdoor torch has a housing mounted on an upright, such as a pole or other support, and is arranged to removably receive an oil lamp, candle or the like which is lit for illumination and/or repelling insects, such as mosquitoes. The housing typically is in the form of a basket made from a fire resistant material, such as bamboo, supported on a pole which is driven into the ground to hold the basket in an upright position.

SUMMARY OF THE INVENTION

An object of the invention is to provide an outdoor torch including a housing defining a cylindrical receptacle for receiving a flaming illumination means, such as an oil burner or a candle, and a removable flameguard for covering the outside surface of the housing to provide further protection against the flame from the illuminating means from contacting the other surface of the housing.

Another object of the invention is to provide such an outdoor torch including indicia on the outer surface of the flameguard to enhance the aesthetic appearance of the torch.

Other objects, aspects and advantages of the invention would become apparent to those skilled in the art upon reviewing the following detailed description, the drawing and the appended claims.

The invention provides an outdoor torch including a housing defining a receptacle for removably receiving a flaming illumination means, such as an oil burner assembly, a support means connected to the lower end of the housing for supporting the housing in an upright position and a removable flameguard of fire resistant material surrounding the outer surface of the housing for preventing flame from the illumination means from contacting the housing.

In one embodiment, the housing is generally cylindrical and the flameguard is in the form of a generally cylindrical sleeve having opposed open ends. The upper end of the sleeve preferably includes an annular flange extending radially inwardly relative to the inside surface and arranged to rest on the upper edge of the housing.

The aesthetic appearance of the flameguard can be enhanced by applying artwork to the outer surface. other suitable indicia, such as a company name and/or logo, a college name, colors and/or logo and the like can be applied to the outer surface of the flameguard for use in connection with special occasions.

DESCRIPTION OF THE PREFERRED EMBODIMENTS

Figure 1:
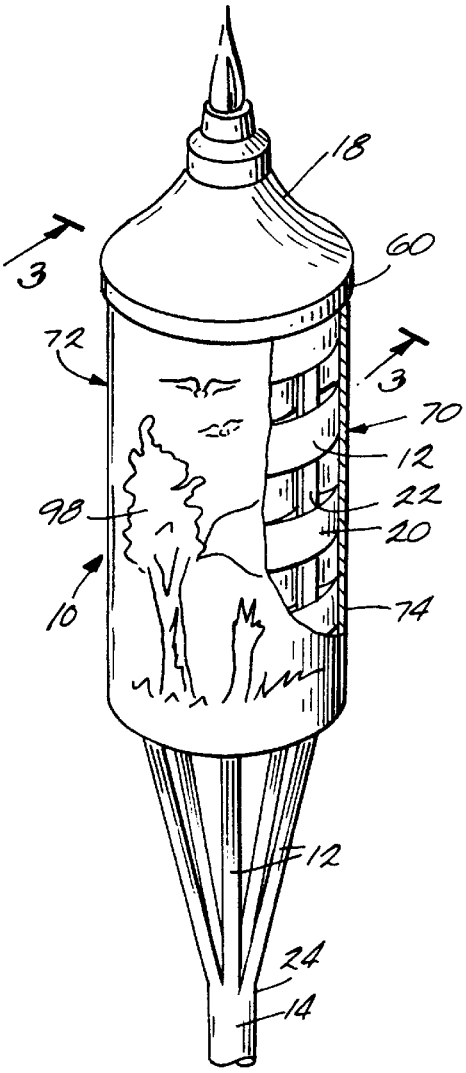
FIG. 1 is a perspective view of the upper part of a patio torch embodying the invention and employing an oil burner assembly.
Figure 2:
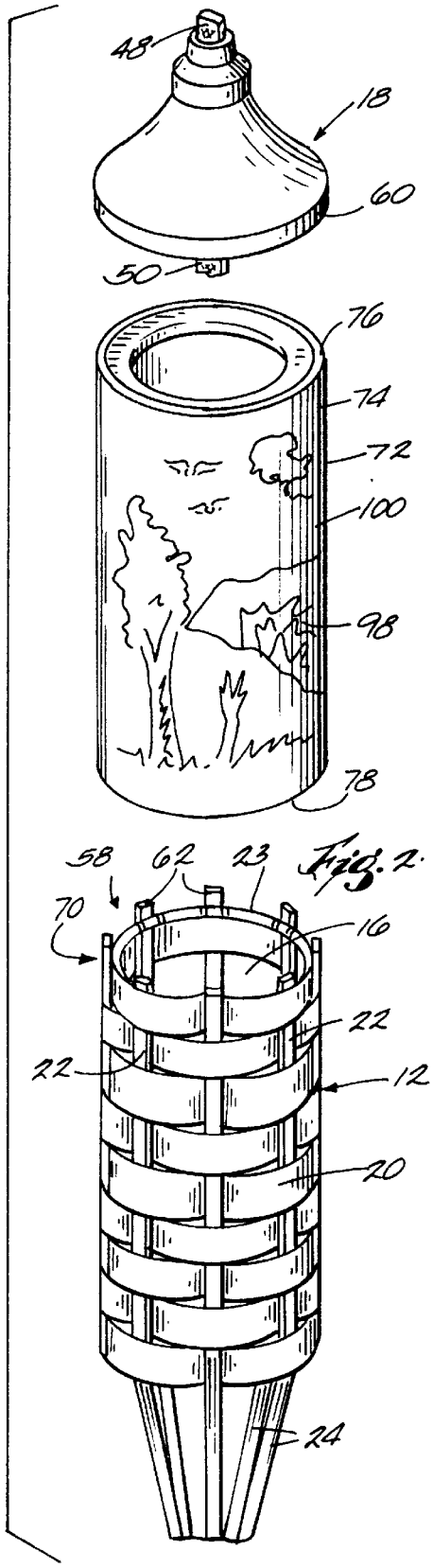
FIG. 2 is an exploded, perspective view of the upper part of the patio torch illustrated in FIG. 1 showing the flameguard and oil burner assembly removed from the housing.

Illustrated in the drawings is a patio torch 10 including a general cylindrical housing or basket 12 and a post 14 connected to the basket 12. In the specific embodiment illustrated, the basket 12 is made from a fire resistant bamboo material and defines a receptacle 16 for receiving an oil burner assembly 18 and the post 14, also made from bamboo, has a lower end (not shown) which is driven into the ground or otherwise suitably supported to hold the torch 10 in a vertical or upright orientation. As best shown in FIG. 2, the basket 12 consists of the plurality of circumferentially extending bands 20 of bamboo woven between a plurality of elongated, circumferentially spaced strips 22 connected to and extending axially from the top end 24 of the post 14. A circular ring 23 of bamboo material located inside the basket 12 at the upper and lower ends of the basket (only one at upper end shown) and suitably fastened to the strips 22 retain the generally cylindrical shape of the basket 12.

Figure 3:
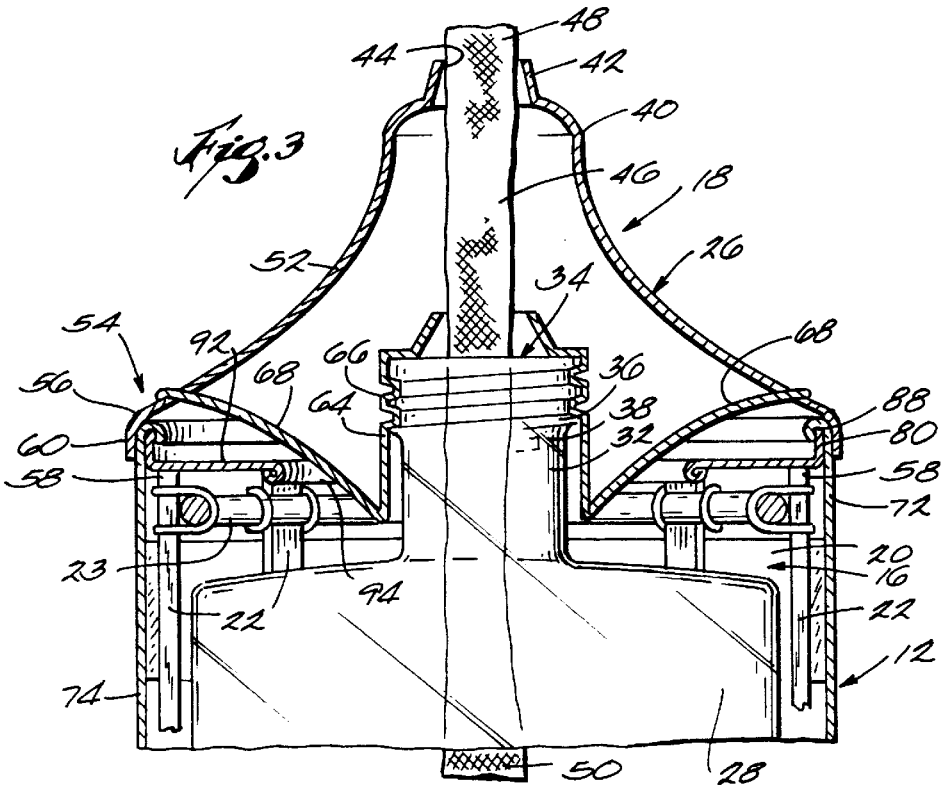
FIG. 3 is an enlarged sectional view taken generally along line 3—3 in FIG. 1.

As best shown in FIG. 3, the burner assembly 18 includes a wick holder 26 removably mounted on a bottle or container 28 which fits into the torch receptacle 16 and contains a liquid fuel. The liquid fuel can be lamp oil with or without additives such as flame coloring additives and/or citronella or a similar additive for repelling insects.

The container 28 preferably is in the form of a bottle molded from an inexpensive synthetic thermoplastic material, such as polyvinylchloride, or a synthetic thermosetting material. The container 28 has an upstanding neck 32 defining an opening 34 through which the liquid fuel 30 is introduced into the container 28 and includes helical male threads 36 on the outer surface 38. If constructed from an inexpensive plastic material, the container 28 can be refilled or disposed when the liquid fuel is depleted.

The wick holder 26 preferably is made from a metal, such as tin plated steel, and includes a raised, generally central portion 40 having a top wall 42 defining a central opening 44 for receiving an elongated wick 46. The wick 46 includes an upper portion 48 which extends outwardly through the opening 44 and is exposed for lighting and a lower portion 50 which extends through the container opening 34 and into the liquid fuel when the wick holder 26 is installed on the container 28 as described in more detail below.

The wick holder 26 includes a generally frusto conical skirt 52 connected to and tapering downwardly and away from the central portion 40. The skirt 52 has a lower portion 54 terminating in a collar 56 which fits over the upper edge 58 of the basket 12 and has a peripheral downwardly extending flange 60 which extends around the upper portion of the basket 12. In the specific embodiment illustrated, the upper ends 62 (FIG. 2) of the bamboo strips 22 form the upper edge 58 of the basket.

The wick holder 26 also includes a cap 64 suitably supported from the skirt 52 for mounting the wick holder 26 onto the container neck 32. In this regard, the cap 64 includes internal helical female threads 66 which mate with the male threads 36 on the container neck 32. To minimize the transfer of heat from the wick holder skirt 52 to the cap 60 when the wick 46 is burning, the cap 60 preferably is connected to the skirt 52 by a plurality or circumferentially spaced spoke members 68 extending radially between and connected to the cap 64 and the skirt 52.

To prevent flame from a burning wick from contacting the outer surface 70 of the basket 12, particularly during windy conditions, the invention provides a flameguard 72 which is made from a fire resistant material, such as stainless steel, and is slidably mounted over the outer surface 70 of the basket 12. The flameguard 72 preferably is in the form of a generally cylindrical sleeve 74 with both the upper end 76 and the lower end 78 open. Except for a portion adjacent to the upper end 76, the inside diameter of the sleeve 74 preferably approximates, but is slightly larger than, the maximum outside diameter of the basket 12 so that the sleeve 74 fits snugly over the basket 12.

The upper end 76 of the sleeve 74 includes a radially inwardly extending ledge which engages the upper edge 58 of the basket 12 as the sleeve 74 is slipped over the basket 12 and thereafter rests on the upper edge 58 of the basket 12 to act as a support for the sleeve 74.

Figure 4:
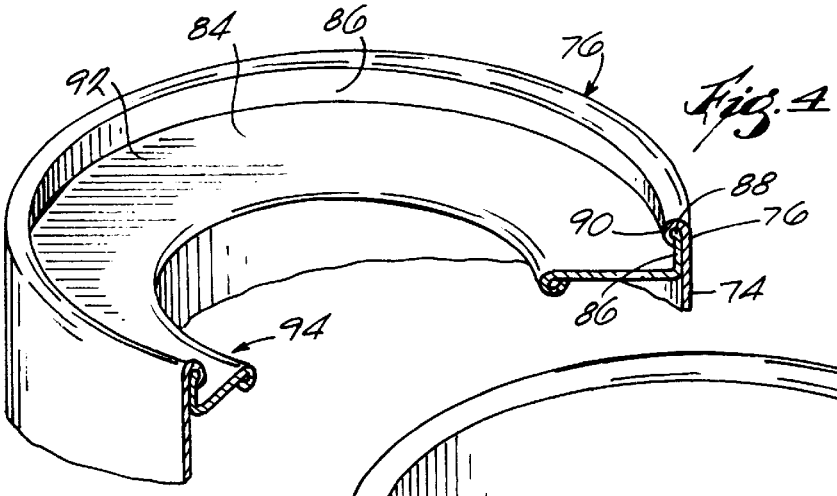
FIG. 4 is a fragmentary perspective view of the upper portion of the flameguard illustrated in FIG. 3.

In the embodiment illustrated in FIGS. 2–4, the ledge is the form of an annular disc 84 having an outer periphery in the form of an upturned annular flange 86 which fits inside the upper end 76 of the sleeve 74 and terminates in an enlarged upper lip 88. The disc 84 is retained inside the sleeve 74 by a portion 90 of the upper end 76 of the sleeve 74 which is rolled over and captures the upper lip 88 of the disc 84. A radially inwardly planar portion 92 of the disc 84 rests on the upper edge 58 of the basket 12. The inside periphery 92 of the disc 84 can be rolled over as illustrated to eliminate sharp edges which could cause cuts to a users fingers and/or a container when a container is installed into and removed from the basket receptacle 16.

Figure 5:
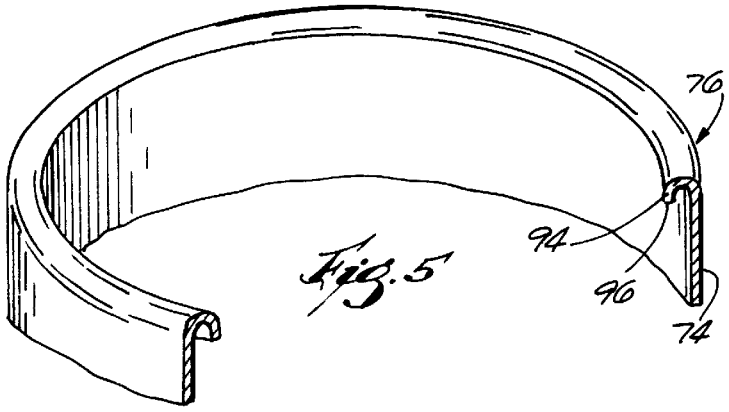
FIG. 5 is a view similar to FIG. 4 illustrating an alternate embodiment of the flameguard.

In the embodiment illustrated in FIG. 5, the support ledge is in the form of an inturned flange 94 terminating in an annular surface 96 which rests on the upper edge 58 of the basket 12.

Different types of indicia 98 can be applied to the outer surface 100 of the sleeve 74 to enhance the aesthetic appearance of the torch 10. For example, artwork as illustrated or product name and/or logo, college team name, colors and/logo, can be applied to the outer surface 100 of the sleeve 74.

For use, the sleeve 74 is slipped over the basket 12 prior to installing the burner assembly 18. After the sleeve 74 is installed with the ledge (i.e., the planar portion 92 of the disc 84 as illustrated in FIG. 3) resting on the upper edge 58 of the basket 12, the burner assembly 18 is installed by guiding the container 28 into the receptacle 16 and allowing it to drop until the collar 56 of the wick holder skirt 52 engages the upper edge 58 of the basket 12. When the liquid fuel 30 in the container has been used up, the burner assembly 18 is removed from the receptacle 16 and wick holder 26 is unscrewed from the container 28. If the container 28 is a disposable type, it is discarded, the wick holder 26 screwed onto the replacement container and the burner assembly is placed back into the basket receptacle 16. If the container 28 is refillable, liquid fuel is poured into the container 28, the burner assembly 26 screwed back onto the container 28 and the burner assembly placed back into the basket receptacle 16.

The container 28 preferably is made from a transparent or translucent thermoplastic material so that the amount of liquid fuel in the container can be determined without removing the wickholder 26.

From the foregoing description, one skilled in the art can easily ascertain the essential characteristics of the invention and, without departing from the spirit and scope thereof, make various changes and modifications to adapt it to various usage.

I claim:

1. An outdoor torch comprising a housing defining a receptacle for removably receiving a flaming illumination means, said housing having an open upper end through which said illumination means can be placed into and removed from said receptacle, a lower end and an outer surface;

support means connected to the lower end of said housing for supporting said housing in an upright position;

a flameguard of fire resistant material slidably mounted over the outer surface of said housing for preventing flame from the illumination means from contacting the outer surface of said housing said flameguard comprising a generally cylindrical sleeve having an open upper end including an inner surface and an opposed lower end, said upper end including a support ledge extending radially inwardly relative to the inner surface of said upper end for supporting said sleeve on the upper end of said housing; and said illumination means comprises a burner including a container for a liquid fuel which fits inside said receptacle and an opening for introducing a liquid fuel into said container, a wickholder covering said container opening and carrying an elongated wick including a portion disposed in the liquid fuel in said container when said wickholder is mounted on said container and another portion exposed for lighting, said wickholder having an annular collar portion extending over and around the upper end of said housing and the upper end of said sleeve when said sleeve is mounted on said housing.

2. An outdoor torch according to claim 1 wherein the upper end of said housing terminates in an upper edge; and said support ledge comprises an annular flange extending radially inwardly relative to the inner surface of the upper end of said sleeve and arranged to extend over and rest on the upper edge of said housing.

3. An outdoor torch according to claim 1 wherein said housing is a basket made from a flame resistant bamboo; and said support means is a bamboo pole connected to said basket.

4. An outdoor torch according to claim 3 wherein said sleeve is metal.

5. An outdoor torch according to claim 1 wherein the outer surface of said flameguard includes indicia for enhancing the aesthetic appearance of said torch.

* * * * *